US005921186A

United States Patent [19]

Hawthorne et al.

[11] Patent Number: 5,921,186

[45] Date of Patent: Jul. 13, 1999

[54] BOLSTER LAND ARRANGEMENT FOR A RAILCAR TRUCK

[75] Inventors: V. Terrey Hawthorne, Lisle; Charles Moehling, Arlington Heights; Charles P. Spencer, Staunton, all of Ill.; Terry L. Pitchford, St. Louis, Mo.

[73] Assignee: AMSTED Industries Incorporated, Chicago, Ill.

[21] Appl. No.: 08/850,178

[22] Filed: May 2, 1997

Related U.S. Application Data

[51] Int. Cl.[6] ..... B61F 5/00

[52] U.S. Cl. ..... 105/207; 105/197.05

[58] Field of Search ..... 105/197.05, 198.2, 105/198.3, 198.4, 198.5, 207

[56] References Cited

U.S. PATENT DOCUMENTS

| | | | |
|---|---|---|---|
| 2,192,171 | 3/1940 | Akitt | 105/207 |
| 2,199,360 | 4/1940 | Light | 105/207 |
| 2,200,571 | 5/1940 | Barrows | 105/207 |
| 2,220,218 | 11/1940 | Cottrell | 105/207 |
| 2,378,415 | 6/1945 | Light | 105/197 |
| 2,422,201 | 6/1947 | Lehrman | 105/197 |
| 2,597,909 | 5/1952 | Tack | 105/197 |
| 2,911,923 | 11/1959 | Bachman et al. | 105/198.2 |
| 3,109,387 | 11/1963 | Tack | 105/207 |
| 3,339,498 | 9/1967 | Weber | 105/207 |
| 3,408,955 | 11/1968 | Barber | 105/197 |
| 3,901,163 | 8/1975 | Neumann | 105/197 DB |
| 4,084,513 | 4/1978 | Bullock | 105/197 DB |
| 4,276,833 | 7/1981 | Bullock | 105/197 DB |
| 4,370,933 | 2/1983 | Mulcahy | 105/197 DB |
| 4,440,095 | 4/1984 | Mathieu | 105/207 |
| 4,491,075 | 1/1985 | Neumann | 105/207 |
| 5,072,673 | 12/1991 | Lienard | 105/198.2 |
| 5,331,902 | 7/1994 | Hawthorne et al. | 105/198.2 |

OTHER PUBLICATIONS

"Final Report Testing, Evaluation and Recommendations Curving Performance of 125T DS Cars" by Rail Sciences, Inc., Atlanta, Georgia, Feb. 12, 1993.

ASME Paper 79–WA/RT–14, "Truck Hunting in Three–Piece Freight Car Truck", (no date).

Association of America Railroad Standard S–318–78, p. D–119 in the Manual of Standards and Recommended Practices, (no date).

Manual of Standards and Recommended Practices of the Association of America Railroads, p. D–II–200.25, (no date).

*Primary Examiner*—Mark T. Le

*Attorney, Agent, or Firm*—Edward J. Brosius; F. S. Gregorczyk; Stephen J. Manich

[57] ABSTRACT

A railway truck assembly has an arrangement for constraining the free travel clearance between the mated bolster and side frame at the side frame window, and more particularly for reducing or eliminating the clearance or separation gap between the bolster lands and the side frame column wall at the outer edges of the bolster lands and the column wall for reduction of truck warping during service.

26 Claims, 8 Drawing Sheets

BOLSTER LAND ARRANGEMENT FOR A RAILCAR TRUCK

BACKGROUND OF THE INVENTION

The present invention relates to railcar truck assemblies and more specifically to an arrangement of the lands between the side frames and bolster of a railcar truck assembly. Particularly, at each intersection of the side frames with the bolster adjacent to the friction shoe wear plate interface, the facing lands are assembled at a gap separation distance of less than four-tenths inch. Assembly of the truck with this restriction provides an inhibition to truck warping with consequent improvement of truck hunting and curving performance during railcar operation.

In previous railcar truck assemblies, wide laterally extending stop surfaces or lands adjacent to the side frame wear plate and bolster friction shoe pocket have been provided to avoid rotation of the bolster about its longitudinal axis, that is bolster rotation. Further, each side frame of the railcar truck assembly has a longitudinal axis parallel to the truck longitudinal axis. The bolster longitudinal axis intersects and is perpendicular to the side frame longitudinal axes at an as-assembled condition. Rotation of the bolster about its central vertical axis causing angular displacement of the intersection of the side frame and bolster longitudinal axes from their perpendicular, as-assembled state is considered to be truck warping. These bolster positions presume an angled position relative to the side frames, as the bolster is generally perpendicular to the side frames at an as-assembled state. The angled positions for bolster rotation and warp were permitted by too great a clearance between the side frame column and the bolster. In the case of railcar truck warp, the greater clearance aggravates the conditions causing the wheel flanges to attack the rail at a relatively severe angle during curving, thus inducing excessive lateral forces. Further, if this column-bolster clearance is too great, truck assembly hunting may be aggravated.

Railcar truck hunting is a continuous instability of a railcar wheel-set where the truck weaves down the track in an oscillatory fashion, usually with the wheel flanges striking against the rail, creating wheel drag and increased lateral forces on the rail. A related condition referred to as lozenging is an unsquare condition of the side frames and bolster, and it occurs where sideframes operationally remain parallel to each other, but one sideframe moves slightly ahead of the other in a cyclic fashion; this condition is also referred to as parallelogramming or warping. Warping results in wheel misalignment with respect to the track; it is more pronounced on curved track and usually provides the opportunity for a large angle-of-attack to occur. The displacement or rotation of the bolster about the bolster vertical axis, which is accompanied by angling of its longitudinal axis relative to the side frame, is indicative of railcar truck warping. The concept of truck hunting, that is a highspeed dynamic instability of the railcar wheel sets is manifested by the parallelogramming or lozenging of the truck. Further, truck hunting is also a consequence of the lack of warp stiffness.

The above-noted wide stop surfaces were provided to inhibit rotation of the bolster in the side frame, which thus avoided the above-noted bolster rotational problems about its longitudinal axis; to permit as-cast surfaces to function properly; and, to avoid the wearing or eroding of the contacting surface edges between the bolster and the columns of the side frame bolster opening. In the illustration of U.S. Pat. No. 3,408,955 to Barber, the lands appear noticeably wider than the cited prior art lands. In practice, these wide lands have been noted as having a width of one and three-sixteenth inch (cf., Association of American Railroads, Mechanical Division, Manual of Standatds and Recommended Practices, D-II-200.25).

In a similar fashion, a bolster antirotation stop or lug was provided at the inside face of a side frame column to inhibit rotation of the bolster in the side frame, which also was to avoid the above-noted bolster rotational problems about its longitudinal axis. A representative structure of this stop lug arrangement is illustrated as Standard S-318-78 in the Manual of Standards and Recommended Practices of the Association of American Railroads, Mechanical Division at Page D-119.

The earlier practice of a narrow-land structure with a wide separation between the bolster land and side-frame, column-face land is illustrated in U.S. Pat. No. 2,378,415 to Light. In this patent, inboard and outboard column guide gibs are provided on the bolster for engagement with the inboard and outboard surfaces on the adjacent column. The outboard gibs in this structure have less depth than the widened portion of the bolster opening. A similar gib arrangement is taught in U.S. Pat. No. 2,422,201 to Lehrman. The significant separation distances between the side frame column and the bolster are clearly discernible in the plan views of the figures of these patents.

A technical study of a number of railcar derailments between 1988 and 1992 was conducted by a task force composed of representatives from five railroads, three railcar builders, three truck manufacturers, a major shipper, a major railcar fleet owner, as well as other component suppliers and technical consultants. The task force was to determine the cause of the derailments and to recommend both long-term and short-term solutions for derailment prevention. The results of the study are reported in Final Report, Testing, Evaluation & Recommendations Curving Performance of 125T DS Cars by Rail Sciences Inc. (RSI), Atlanta, Ga., Feb. 12, 1993. One of the parameters considered in the trucks was warp restraint, and as a consequence of the research it was determined that one of the five simultaneously occurring factors leading to the derailments being reviewed was 'warping of sideframe-bolster due to low truck warp restraint'. One of the consequent longterm proposals resulting from the test determinations was to advocate the development and application of truck warp stiffening techniques. A principal finding of the study was that frame stiffening arrangements increase the warp restraint of the trucks and reduce lateral forces in curving. In addition, it was concluded that the studied derailments were the result of high lateral forces rolling the low rail or increasing total gage sufficient to allow a wheelset to drop in. One of the noted causes of these high lateral forces was warping of the sideframe-bolster combination due to low truck-warp restraint caused by the presence of resilient bearing adapter pads and a lack of friction wedge restraint. There were a plurality of other findings and conclusions from this study, which were noted in this report, however, the present invention only addresses the warping restraint within the railcar truck.

SUMMARY OF THE INVENTION

The present invention provides a railway truck assembly with an arrangement to reduce truck warping through constraint of the free travel between the mated bolster and side frame at the side frame columns. The reduction of truck warping is accommodated by reducing or eliminating the clearance or separation gap between the bolster lands and the side-frame columns. The separation gap is particularly minimized at the outer edges of the lands and the side-frame column.

BRIEF DESCRIPTION OF THE DRAWINGS

In the figures of the Drawing, like reference numerals identify like components, and in the drawing.

DETAILED DESCRIPTION OF THE PREFERRED EMBODIMENT

Figure 1:
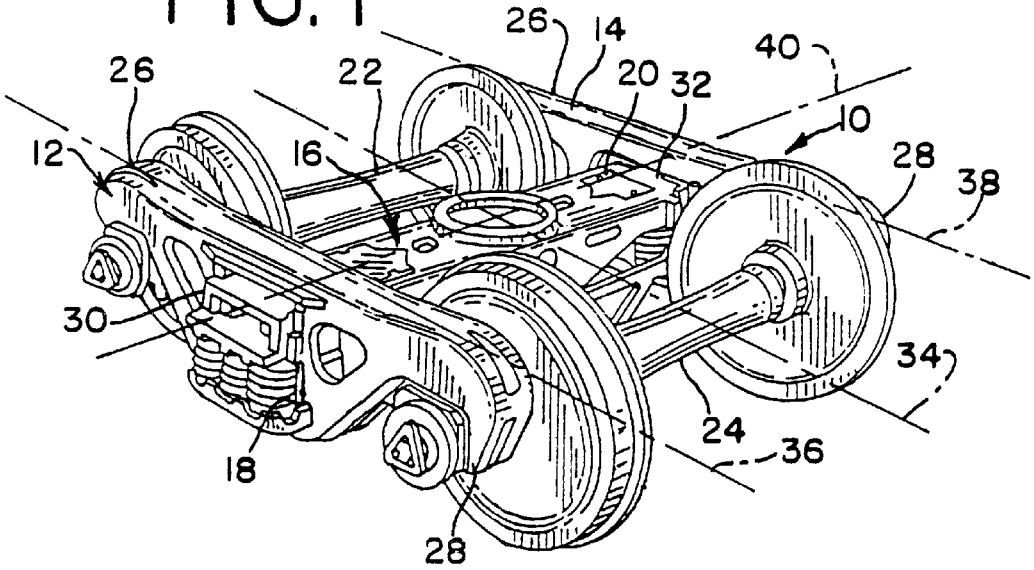
FIG. 1 is an oblique view of a representative three-piece railcar truck assembly.
Figure 2:
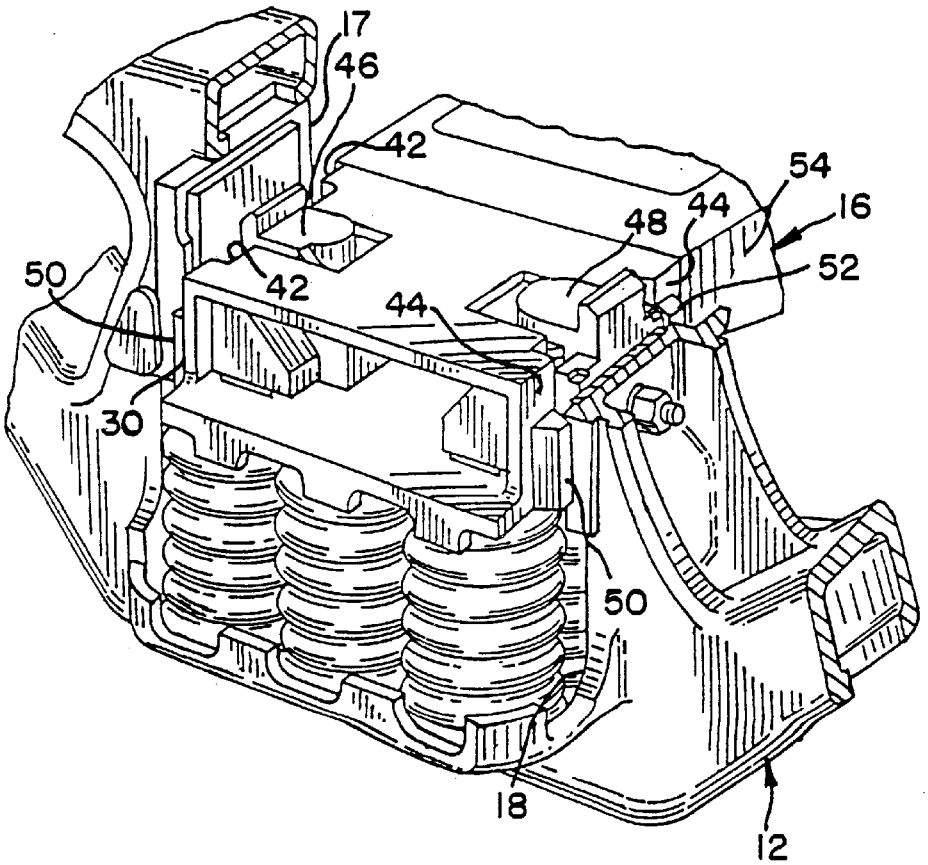
FIG. 2 is an enlarged oblique view in partial section of a portion of the side frame and bolster connection in FIG. 1 at the columns of the side frame.

Railcar truck assembly 10 in FIG. 1 is a representative three-piece truck assembly for a freight railcar (not shown). Assembly 10 has first side frame 12, second side frame 14 and bolster 16 extending between generally central openings 18 and 20, which openings 18 and 20 in FIG. 2 are between forward sideframe column 17 and rearward sideframe column 19, of first and second side frames 12 and 14, respectively. In FIG. 1, railcar longitudinal axis 34 is parallel to both first and second side frame longitudinal axes 36 and 38. Bolster longitudinal axis 40 is generally perpendicular to railcar axis 34 and, side frame longitudinal axes 36 and 38 at the railcar as-assembled reference position. First axle and wheel set 22, and second axle and wheel set 24 extend between side frames 12 and 14 at their opposite forward ends 26 and rearward ends 28, respectively, which side frames 12 and 14 are generally parallel at a reference, as-assembled condition. First bolster end 30 is nested in first side-frame opening 18 and second bolster end 32 is nested in second sideframe opening 20.

The connection of bolster 16 in openings 18 and 20 is similarly configured for either of side frames 12 and 14. Therefore, the following description will be provided for the connection of bolster first end 30 at first side frame opening 18, but the description will also be applicable to the connection of bolster second end 32 in second side frame opening 20. Opening 18 and bolster first end 30, which are illustrated in an enlarged and partially sectioned view in FIG. 2, have exposed bolster columns 42 and 44 between gibs 50 and 52. Friction shoe pockets are provided within bolster columns 42 and 44 with respective friction shoes 46 and 48 therein. At each end of bolster 16, friction shoe-pockets and friction shoes 46 and 48 as well as bolster columns 42 and 44 are longitudinally arranged on forward side and rearward side of bolster 16, respectively, which bolster columns also provide lands 96 noted in FIG. 3. As bolster columns 42, 44 and friction shoe-pockets and shoes 46, 48 at each bolster end are similar, only one arrangement will be described, but the description will be applicable to various sets of friction shoe-pockets and friction shoes and bolster columns 42,46 and 44,48. Bolster gibs or lugs 50 and 52 in FIGS. 2, 5 and 8 project from bolster side wall 54 and are arranged outboard and inboard, respectively, on both the forward and rearward bolster columns 42 and 44, which gibs 50, 52 act to maintain the position of the sideframe therebetween on either side of bolster 16 at each side frame. Although gibs 59 and 52 are shown as relatively independent elements, these elements may be cast or formed as enlarged protrusions of bolster 16.

Figure 8:
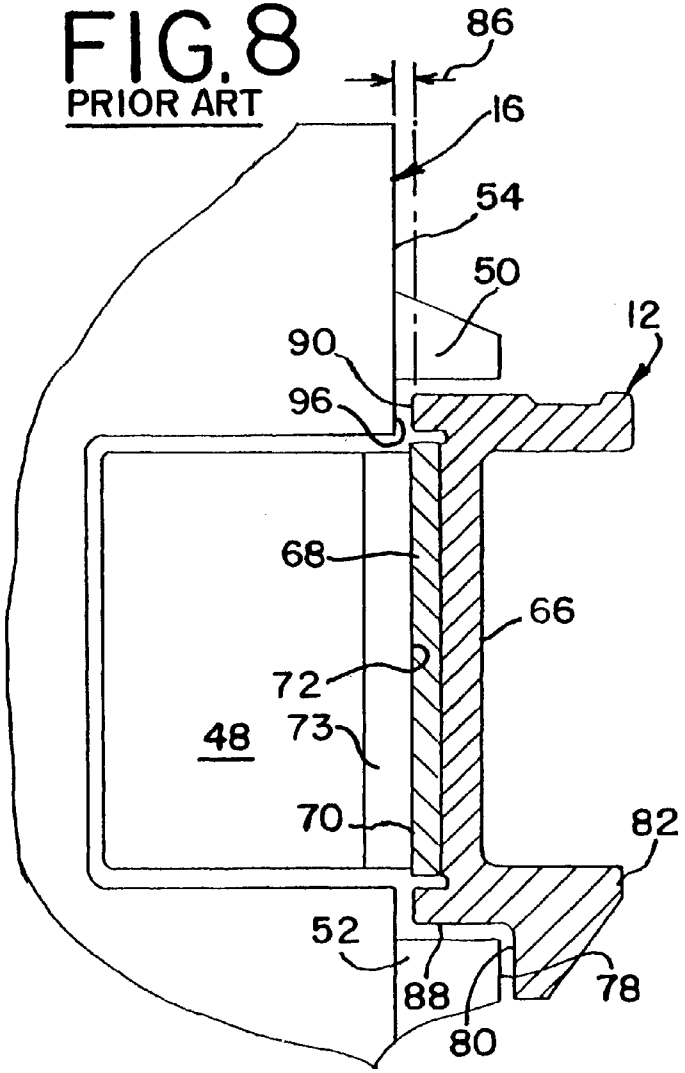
FIG. 8 PRIOR ART
FIG. 8 is a plan view of a prior art wear plate-friction shoe interface as in FIG. 7.
Figure 7:
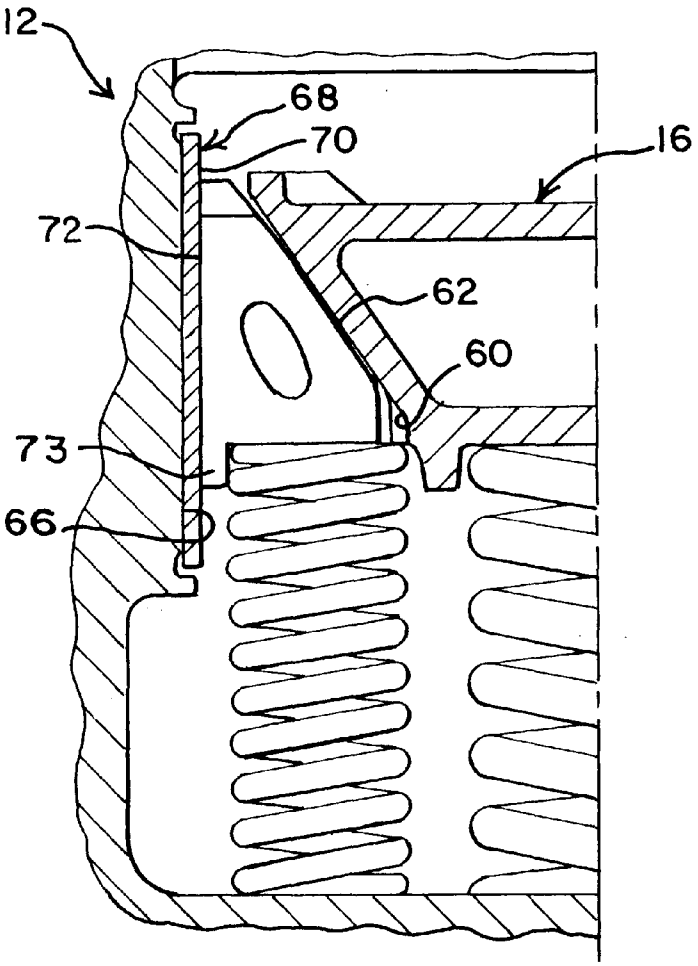
FIG. 7 is a side elevational view of a representative interface between a wear plate on a side frame column and the friction shoe.

The general configuration of friction shoe 48 in a friction shoe pocket provided within bolster column 44 is more clearly illustrated in the sectional views of FIGS. 7 and 8 with bolster wall 60 and land 96, which is provided by bolster column 42 or 44, in proximity to friction shoe sloping surface 62. Side frame column wall 66 has wear plate 68 with vertical wall frictional surface 70 to contact vertical surface 72 of friction shoe vertical wall 73. In another prior art structure, gib 52 in FIG. 8 has outer surface 78 facing stop lug outer surface 80 of side frame stop lug 82. This stop lug and gib arrangement was intended to minimize horizontal movement between bolster 16 and side frame 12, and to inhibit rotation of bolster 16 about its longitudinal axis 40.

Figure 3:
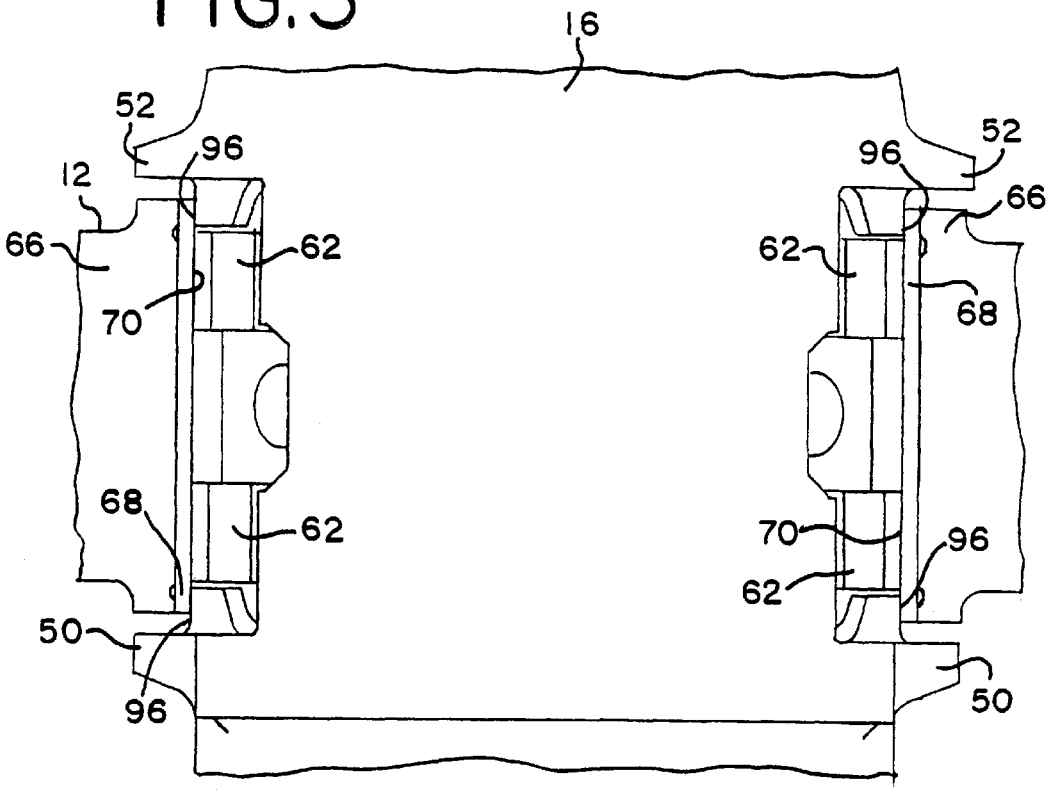
FIG. 3 is a plan view of a side frame and bolster connection at a reference and normal position.
Figure 3A:
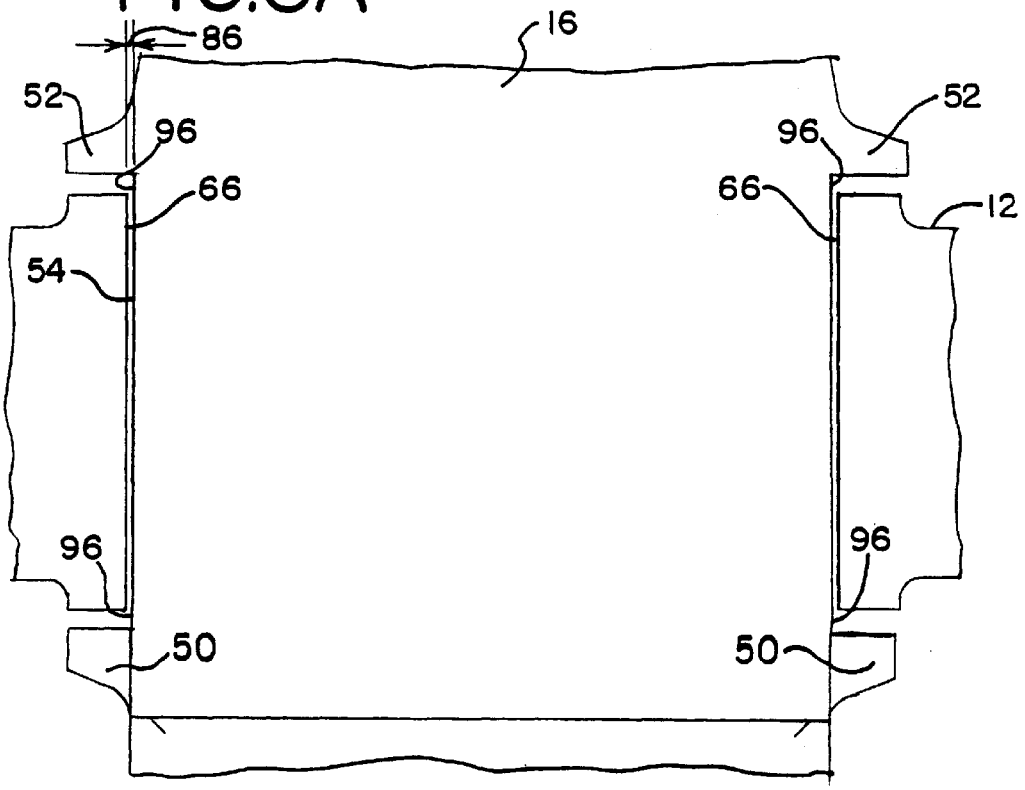
FIG. 3A is a plan view of a side frame and bolster connection with a column wall and bolster wall contact surface.
Figure 5:
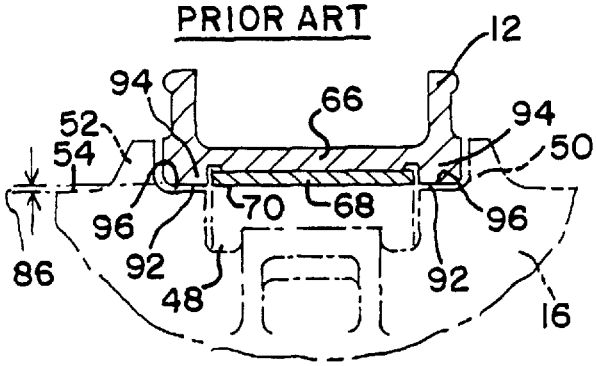
FIG.5 PRIOR ART
FIG. 5 is a plan view segment in partial section of a side frame and bolster intersection of prior art wide land arrangements.

Gap distance 86 is particularly shown in FIGS. 3A, 5 and 8. In FIG. 3A, gap distance 86 is noted between side frame column wall 66 and bolster column wall 54; in FIG. 5, gap 86 is noted between land 96 on bolster column 42 or 44, and surface 92 of side frame land 94; and, in FIG. 8, gap 86 is noted between land 96 and overlapping projection 90, which are aligned with bolster wall 54 and wear plate vertical wall surface 70, respectively. The specific locating point may vary with the design of the bolster column and side frame column arrangement. However, the gap distance 86 is generally about three-eighths inch up to approximately one inch in present railcar truck assemblies.

Figure 6:
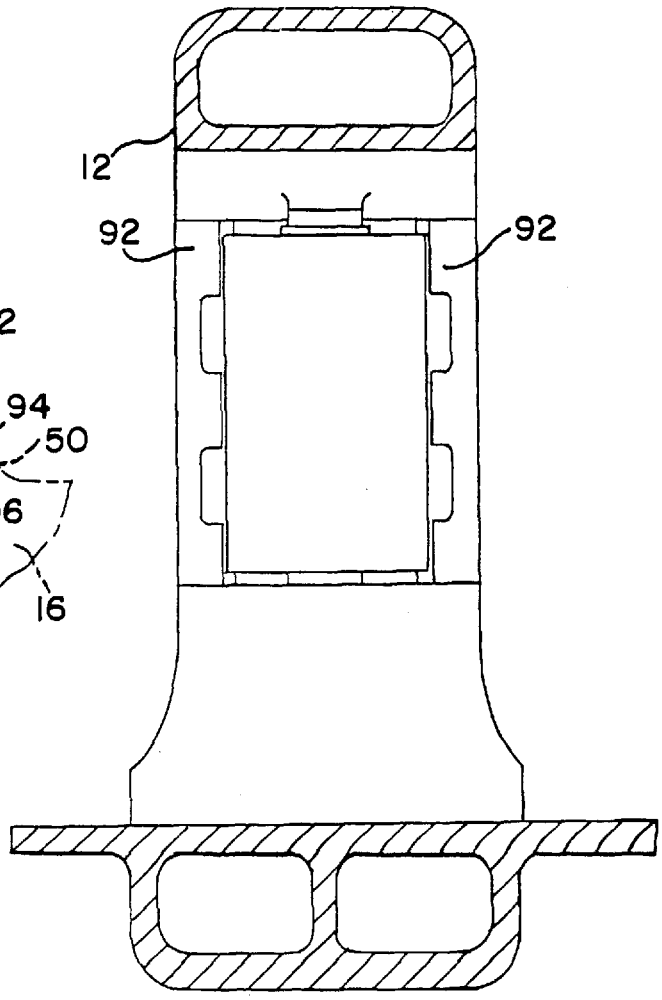
FIG.6 PRIOR ART
FIG. 6 is an elevational view of the side frame column, as noted in FIG. 5.

In a specific prior art embodiment, the railcar truck arrangement has separation gap 86 between projections 88, 90 (FIG. 8) and 94 (FIG. 5), and bolster sidewall 54, as noted in FIGS. 5, 6 and 8. However, in the structure of FIG. 5, projections 94 have a longitudinal width significantly greater than predecessor arrangements, and this structure has been dubbed the wide-land arrangement. This wide-land structure was intended to reduce rotation of the bolster about bolster longitudinal axis 40 relative to the side frame, and to reduce wear on the side frame and bolster surfaces which come into contact during service operations. In this embodiment, surfaces 92 of lands 94 were to contact surfaces 96 of bolster 16. Lands 94 were elongated projections on the column of side frame 12 with wear surfaces 92 closely adjacent spaced guide surfaces or lands 96 of column 42 or 44 of bolster 16.

Figure 4:
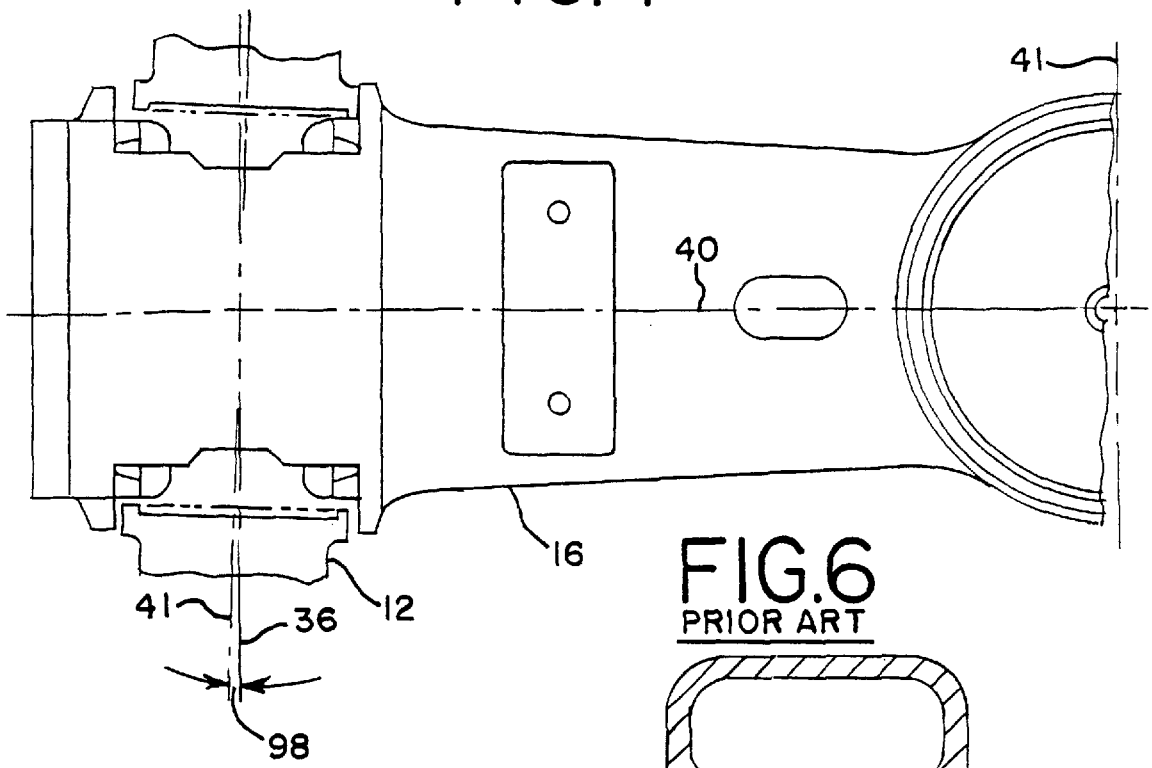
FIG. 4 is a plan view of the side frame and bolster connection of FIG. 3 wherein the bolster and side frame are angularly displaced from the reference position.
Figure 9:
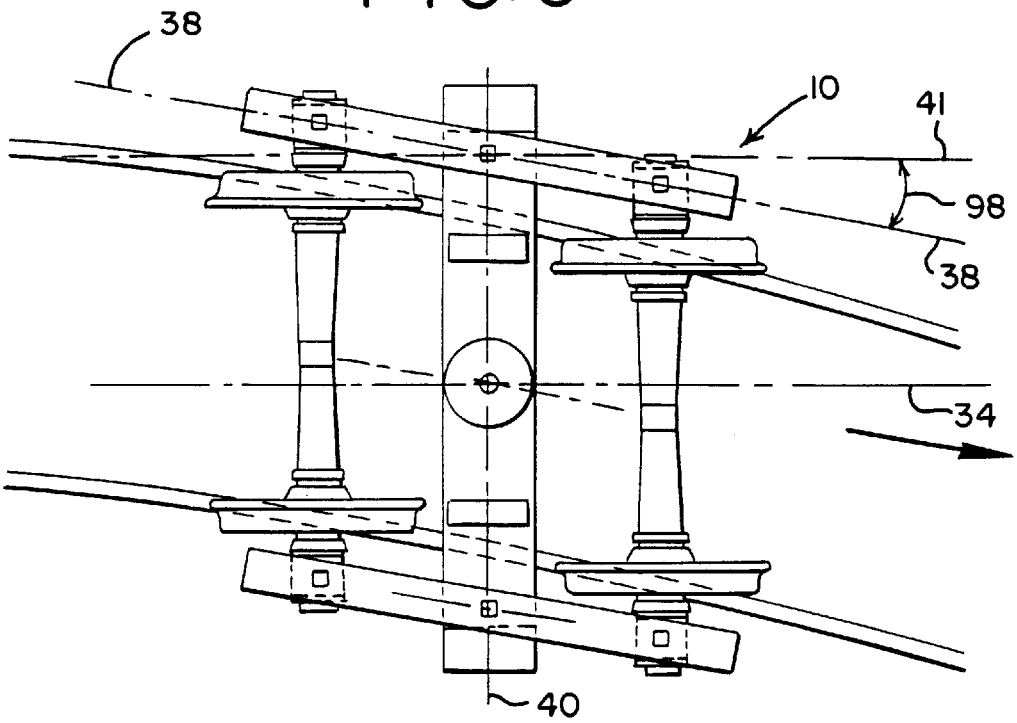
FIG. 9 is a diagrammatic plan view of a three-piece railcar truck frame being warped during negotiation of a curve on rail track.
Figure 10:
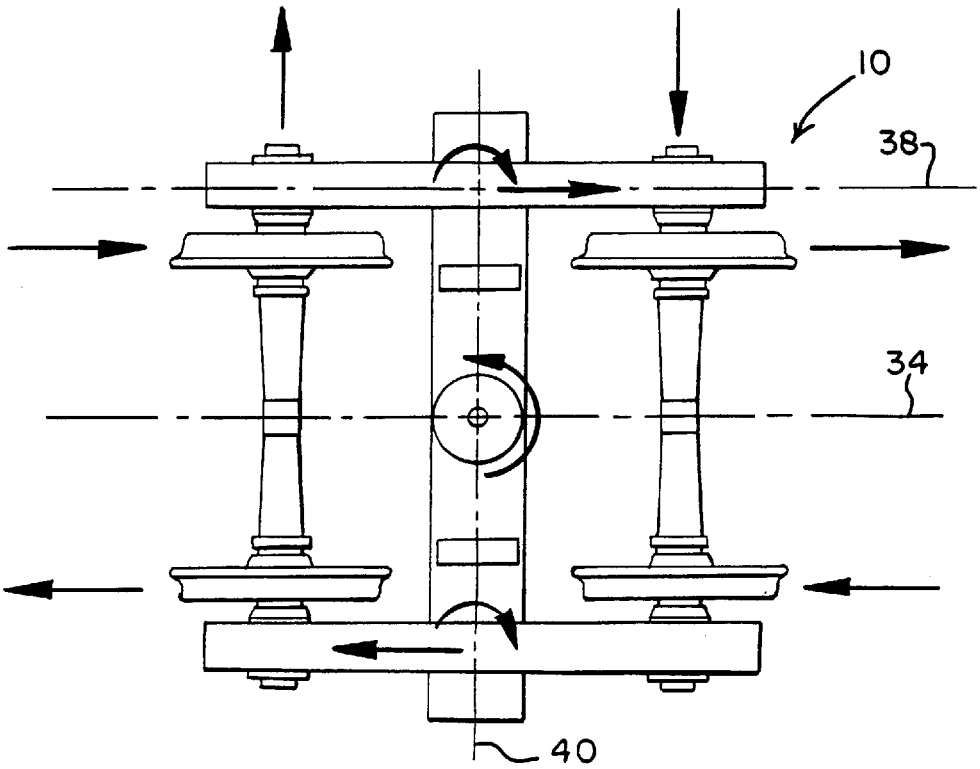
FIG. 10 is a plan view of a three-piece railcar truck at a reference or normal position and illustrating the various moments and forces acting on such truck assembly.

The angular displacement between side frame 12 and bolster 16 is illustrated in FIGS. 4 and 9 by the angular displacement or warp angle 98 between side frame longitudinal axis 36 and bolster transverse axis 41 in FIG. 4, or axes 41 and 38 in FIG. 9. In one measured arrangement, this angular displacement was noted as 1.54°. The effect of this warping is dramatically illustrated in FIG. 9 by the imposition of the outline of the rail tracks on truck assembly 10. FIG. 9 shows truck frame warping during curve negotiation, however, truck assembly 10 in this figure is embellished to reflect the relationship between the side frame and bolster and to clearly demonstrate the truck warping. During operation, railcar truck 10 is displaced from its reference position wherein longitudinal axes 38 of sideframes 12 are normal to longitudinal axis 40 of bolster 16. The angular displacement has been referred to as warping of the railcar truck. The forces affecting or impacting the warping characteristics are noted in FIG. 10 by the various arrows, wherein a turning moment is noted at the center plate region of the bolster, lateral forces are acting at the ends of the bolster and longitudinal forces are inducing steering moments.

In FIG. 3, the present invention provides the interface between the contact surfaces of the lands, conventional (FIG. 8) or wide-land (FIG. 5) designs or rotation stops, in contact with each other, or at a negligible separation distance 86. It has been found that providing this close proximity of the lands at the interface of bolster 16 and side frame 12 or at the bolster columns, limits or improves warping of truck assembly 10. In this embodiment of FIG. 3, gap or spacing 86 has been closed for direct contact between wear plate 68 and lands 96 on bolster 16. Lands 96 are formed on the surface adjacent to the friction shoe pockets. In this preferred embodiment, wear plate 68 extends across the width of side frame column wall 66. However, it is noted that projections or lands 94 are provided on either side of wear plate 68 in FIG. 5, and land or front face 92 of these lands may be coplanar with the surface 70 of wear plate 68. FIG. 3A shows the bolster column wall or spaced guide surface 96 as a continuum between gibs 50 and 52. Similarly, vertical walls 66 of the side frame column are each noted as a single vertical wall. In this embodiment, the utilization of a friction shoe and friction pocket have been obviated. In a further enhancement of this embodiment, the vertical surfaces 66 and 96 may be hardened surfaces, such as by air and flame hardening or by the application of a hardened material coating, such as through plasma arc or flame sprayed coating. The hardening of the surfaces or the application of the hardened material coating provides improved wear between the contacting faces 66 and 96. Similar hardening techniques may be applied or utilized in the contact surfaces of the alternative embodiments.

Although wear plate surface 70 is noted in contact with surface 96 in FIG. 3, tests have noted that control of the angling between bolster 16 and side frames 12 or 14, can be accommodated when gap distance 86 is less than four-tenths (0.40) inch, and preferably closer to fifteen thousandths (0.015) inch. In an experiment on a railcar truck with the requisite reduction in gap distance 86, the truck warping or lateral stability of the trucks was maintained to meet AAR Chapter XI stability criteria (0.26 G rms at 70 mph) for a Super Service Ridemaster® Truck Assembly with double roller side bearings, as was another railcar truck assembly with constant contact side bearings (CCSB). Control of the angling-warping condition in the truck assembly by increasing the warp stiffness improves the lateral stability and reduces the lateral curving forces at the wheel to rail interface, thereby improving the hunting and curving performance of truck assemblies especially in a particular freight railcar, a bulk-head flat railcar. Limiting the gap separation distance minimizes or limits the permitted warping angle to an angular displacement between about 0.1° (1.7 milliradians) and 2.0° (35 milliradians).

Figure 11:
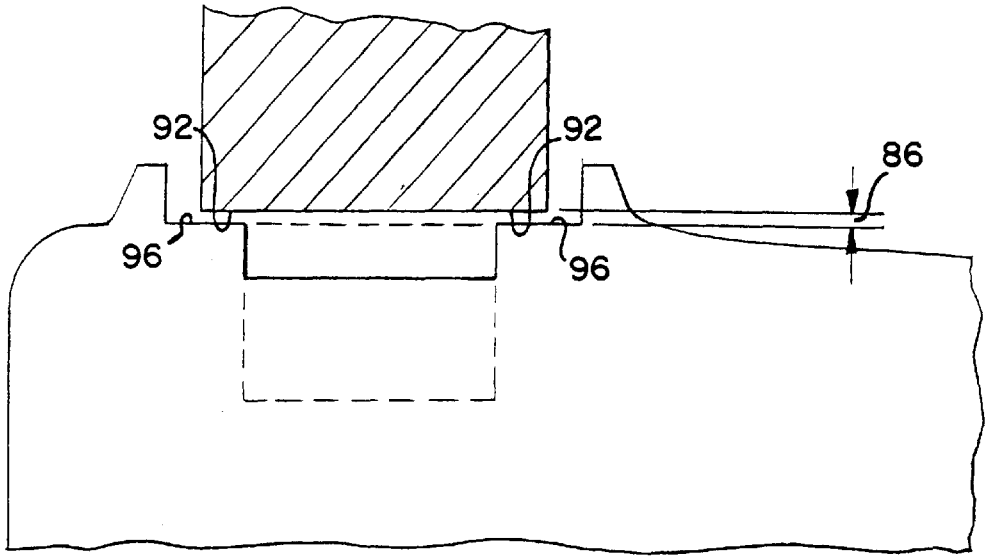
FIG. 11 is a plan view illustration of lands in parallel planes.

Alternative embodiments of the present invention are noted in FIGS. 11, 12, 13 and 14. In these figures, wear plate 68 has been removed to more clearly illustrate the relation between the lands of the side frame column and the bolster. In FIG. 11, the relationship between the lands 92 of side frame 12 and lands or contact surfaces 96 of bolster 16 are shown wherein the side frame column surfaces and wear plate surface 92 are coplanar. In addition, the bolster lands or contact surface 96 are coplanar, and consequently, gap distance 86 is defined between these planar surfaces.

Figure 12:
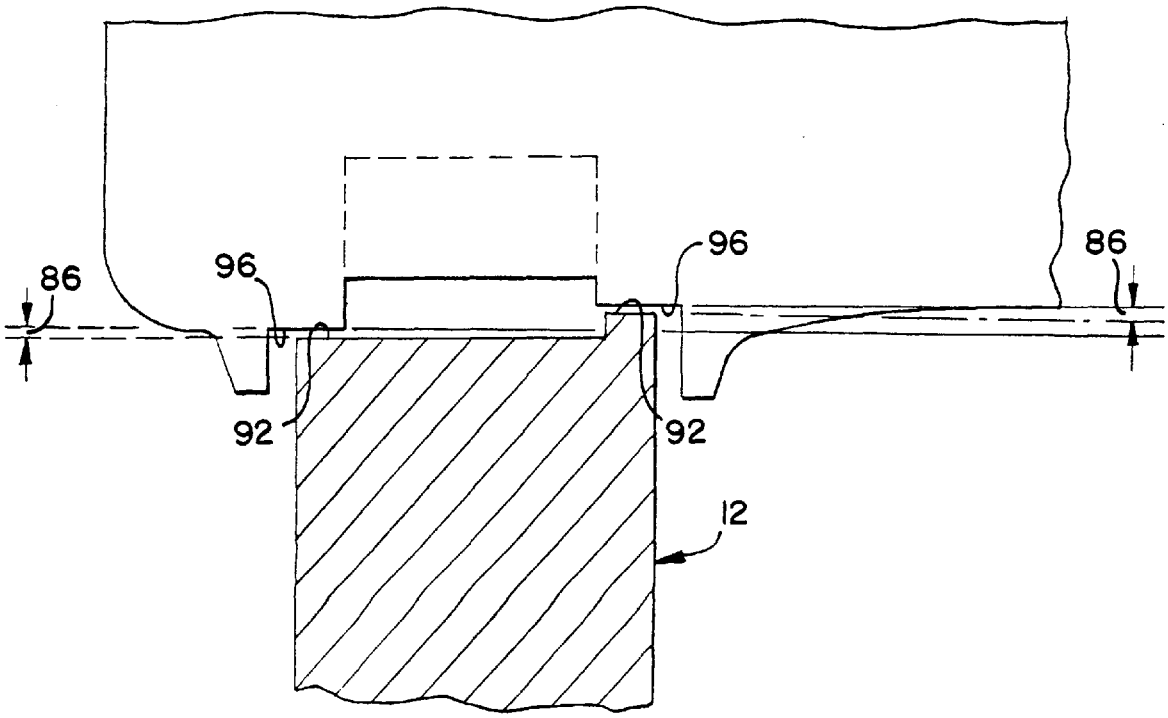
FIG. 12 is a plan view illustration of a lands in parallel but offset planes.

In FIG. 12, the facing surfaces 92 and 96 are parallel to each other at each location or gib area. However, lands 92 on either side of side frame 12 are offset from each other, but the surfaces are in in parallel planes. Similarly the planes of bolster lands 96 are parallel to each other but offset. Thus although the planes of the several contacting surfaces are offset from each other, the surfaces of lands 92 and 96 remain parallel to each at their respective positions. In this illustrated embodiment, separation gaps 86 are equivalent in magnitude, but displaced from each other.

Figure 13:
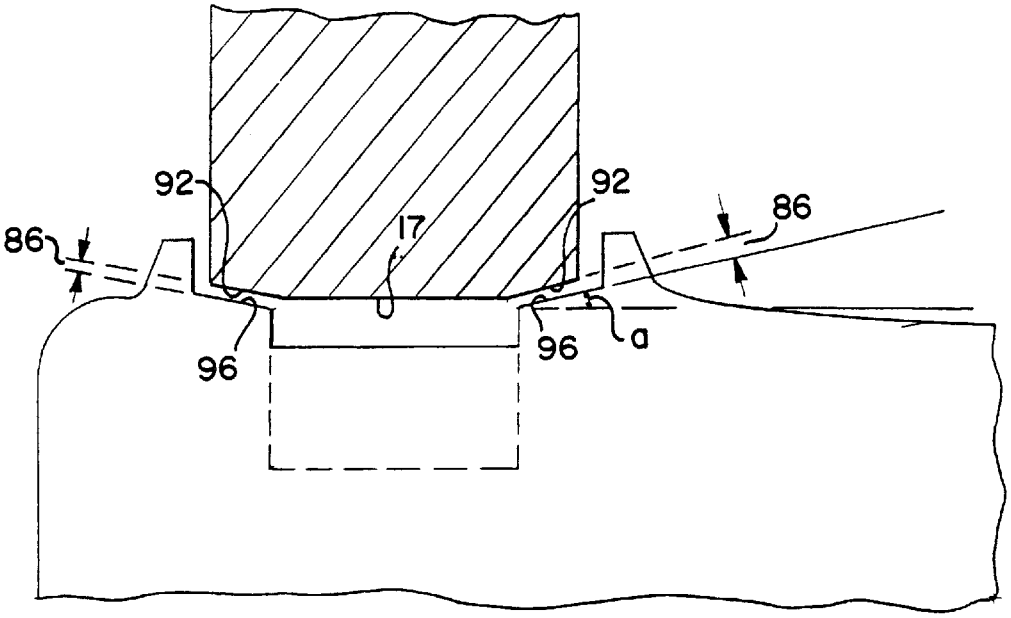
FIG. 13 is a plan view illustration of an arrangement wherein the lands are parallel to each other but angularly displaced inwardly from the plane of the column face.
Figure 14:
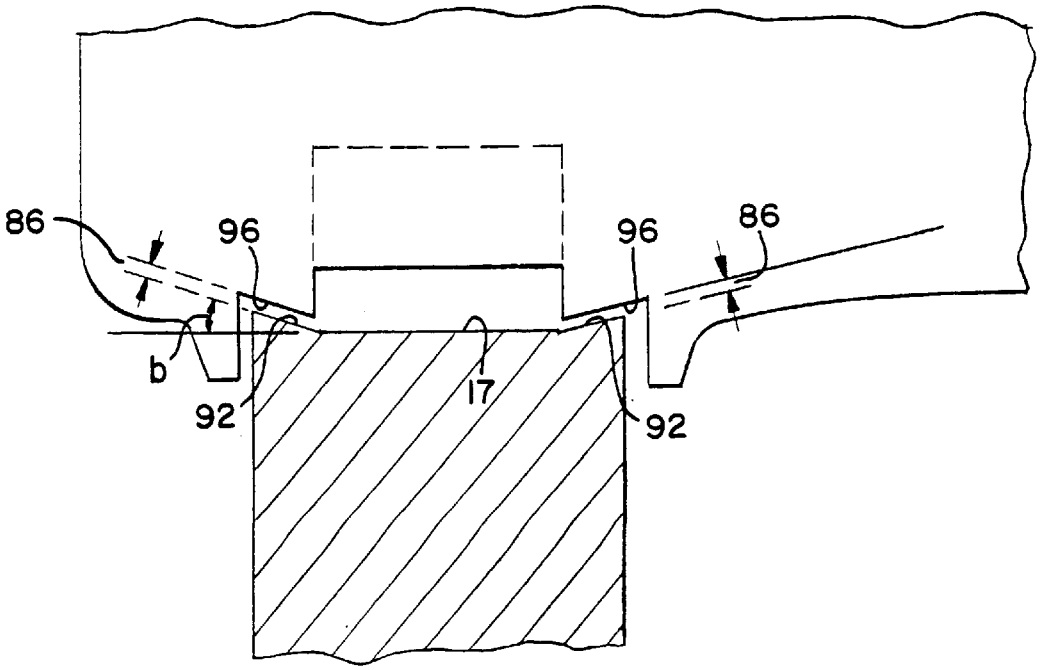
FIG. 14 is a plan view illustration of an arrangement wherein the lands are parallel to each other but angularly displaced outwardly from the plane of the column face.

FIGS. 13 and 14 demonstrate embodiments wherein the lands or contact surfaces 92 and 96 are at acute angles to the plane of the side frame column face. In FIG. 13, the angle 'a' is inwardly displaced from column face 17, and in FIG. 14, angle 'b' is outwardly displaced from column face 17. However, contact surfaces 92 and 96 on either side of the illustrated friction shoe pocket remain in general parallel alignment to each other and the separation gap 86 distances are approximately equal at either side of the friction shoe. Additionally, the arrangement of the lands may be combined, that is one side may have a convex land arrangment with an angle 'a' and the other side of the arrangement may have a concave land with an angle 'b'. Similarly one side may have a convex or concave land with an angular displacement in cooperation with a land arrangement coplanar with the column face.

Figure 15:
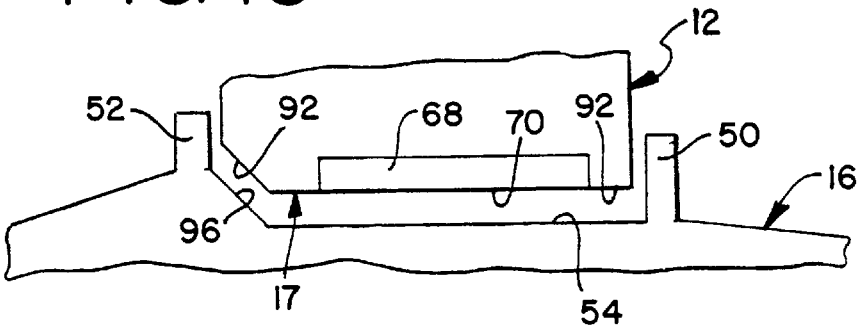
FIG. 15 is a plan view illustration of an arrangement wherein the lands are parallel to each other but one of the pair of lands is angularly displaced from the plane of the column face with a wear plate.

The alternative embodiment of FIG. 15 has side frame 12 with wear plate 68 on column 17. Lands 92 and 96 in proximity to gib 52 are noted at angle 'b' to bolster clearance 54. Lands 92 and 96 in proximity to gib 50, or alternatively the continuation of surface 54, are noted in a generally more parallel plane to wear plate surface 70. This alternative embodiment is noted on only one side of the bolster and side frame but could have been demonstrated with the angular displacement at the opposite gib location.

Figure 16:
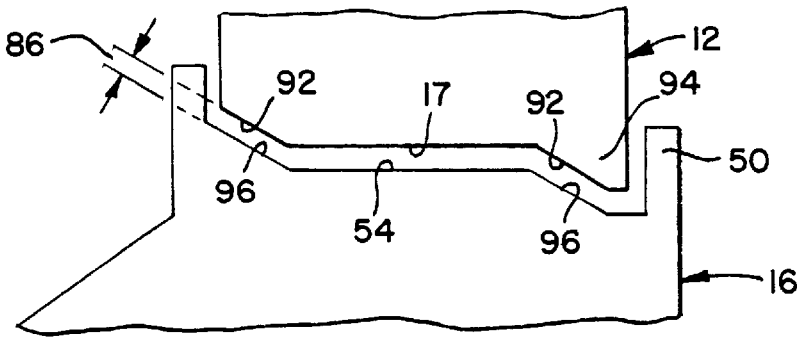
FIG. 16 is a plan view illustration of an arrangement wherein the lands are parallel to each other but angularly displaced in the same direction on both sides of the side frame and bolster; and, FIG. 17 is a plan view illustration of an arrangement wherein the lands are not coplanar with the column wear plate.

FIG. 16 demonstrates an alternative embodiment to the illustration of FIGS. 13 and 14 wherein the angular displacement on either side of the side frame and bolster have the angular displacement in the same direction.

Figure 17:
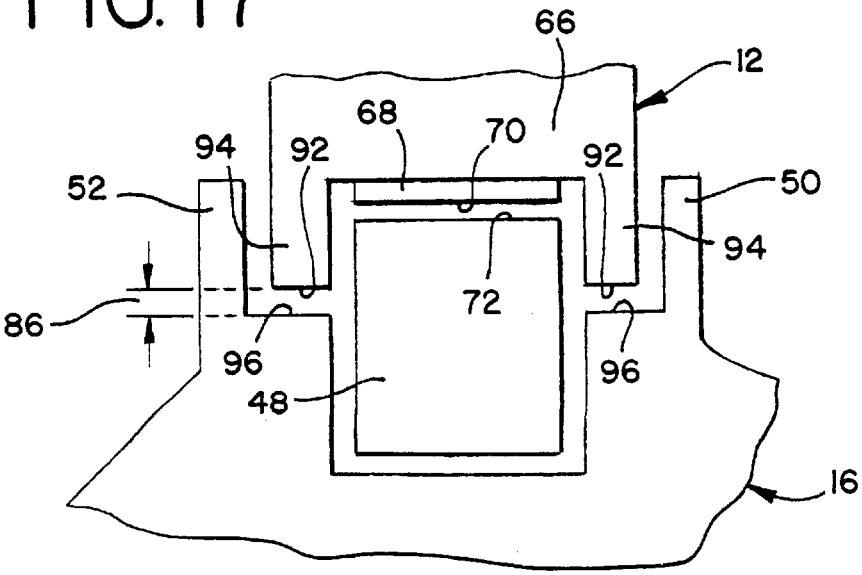

FIG. 17 includes the alternative embodiment to the structure noted in FIG. 3 wherein friction shoe face 72 and wear plate face 70 are displaced from the planes of the faces of lands 92 and 96 on either side of the friction shoe pocket.

Although only a single truck assembly structure 10 has been illustrated, it is known that the bolster column 42 or 44 may be flush with the bolster side wall and the side frame columns 17 and 19 may be recessed to define a pocket for insertion of the friction shoe. It is approximately a mirror image of the arrangement noted above, and is thus not illustrated.

While only specific embodiments of the invention have been described and shown, it is apparent that various alterations and modifications can be made therein. It is, therefore, the intention in the appended claims to cover all such modifications and alterations as may fall within the scope and spirit of the invention.

We claim:

1. In a railcar truck assembly having a railcar truck bolster, a railcar truck first side frame, a railcar truck second side frame and a truck longitudinal axis, each said railcar truck first side frame and second side frame having a longitudinal axis, a forward column, a rearward column, and an opening between said forward column and rearward column, each said side frame longitudinal axis generally parallel to said railcar truck longitudinal axis at a reference position, each said forward column having a forward-column surface and a column width, and each said rearward column having a rearward-column surface and a column width, said forward-column surface and rearward-column surface of each said first side frame and second side frame generally parallel and in facing alignment along said side frame longitudinal axis with said side-frame opening generally between said forward-column surface and rearward-column surface of each said first and second side frame, each said forward-column surface and said rearward column surface of each said first and second sideframe having a wearing column-stop surface, a midpoint along said sideframe longitudinal axis between said forward column surface and rearward column surface of each said sideframe, said bolster having a first end, a second end, a forward bolster side, a rearward bolster side and a bolster longitudinal axis, one of said bolster first and second ends mated with an opening of one of said first and second side frames and the other of said bolster first and second ends mated with an opening of the other of said first and second side frames, said bolster longitudinal axis and said first and second side-frame longitudinal axes generally perpendicular at said reference position, and angular displacement of said bolster axis and side-frame axes from the respective bolster and side-frame perpendicular longitudinal axes reference position defining a truck warp angle therebetween, said forward bolster side and said rearward bolster side at each of said mated first and second bolster ends in proximity, respectively, to a forward-column surface and a rearward-column surface in said respective mated first and second side frame opening, an inboard gib and an outboard gib at each of said bolster forward sides and rearward sides at each said bolster first and second ends, said inboard and outboard gibs at each said bolster forward side and rearward side cooperating to define, respectively, a forward side and a rearward side clearance gap between said inboard and outboard gibs greater than said column width, each said bolster forward side and rearward side defining at least one bolster stop surface between said inboard gib and said outboard gib, when said bolster longitudinal axis is normal to said railcar-truck longitudinal axis and in alignment with said sideframe midpoint at said reference position, and each said bolster forward side stop surface is in a facing and parallel relationship with a forward column-stop surface, and each said bolster rearward side stop surface is in a facing and parallel relationship with a rearward column-stop surface at said reference position, said facing bolster stop-surface and column stop-surface cooperate to define a separation gap between said parallel stop surfaces, said separation gap greater than fifteen thousandths inch and substantially less than ninety-three thousandths inch at said reference position, said sideframe column-stop surfaces at said forward and rearward column surfaces in proximity to said bolster stop surfaces to maintain control of the warp angle between said bolster end and said side frame during curving of the railcar truck assembly for utilization of said railcar-truck bolster and, first and second side frame to reduce hunting of said railcar truck assembly.

2. In a railcar truck assembly as claimed in claim 1, said truck assembly further comprising a plurality of friction shoes, each said friction shoe having a wearing surface, each said bolster first end and second end cooperating with said forward side and rearward side clearance gap between said inboard gib and outboard gib to define a friction shoe pocket, each said side frame having an inboard stop and an outboard stop at each said forward and rearward side of each said bolster end, each said friction-shoe pocket having a friction shoe positioned and operable in said pocket, said wearing surface of each said friction shoe in a friction-shoe pocket aligned with said side frame column surface, which respective column surface is in proximity to said bolster stop surface at said bolster forward and rearward sides.

3. In a railcar truck assembly as claimed in claim 1 further comprising a plurality of wear plates, each said wear plate having at least one wearing surface, at least one of said wear plates secured to each said side frame rearward and forward column surface, said wearing surface on said wear plate of said respective rearward and forward column surface facing, respectively, said bolster rearward and forward side, said wear plate wearing surface operable to contact said bolster stop surface to provide a durable contact surface for said bolster clearance gap and stop surfaces.

4. In a railcar truck assembly as claimed in claim 1 further comprising a plurality of wear plates, each said wear plate having at least one wearing surface, at least one of said wear plates secured to each said side frame column surface with said wearing surface facing, respectively, said bolster rearward and forward side in proximity to said column surface, at least one of said wear plates secured to each said bolster sides at said clearance with said wearing surface facing said side-frame column, wear-plate surface, said wear plate wearing surface and bolster wear-plate wearing surface in contact to provide control of said warp angle against hunting of said railcar truck.

5. In a railcar truck assembly as claimed in claim 3 wherein each said forward side and rearward side stop surface has an inboard stop surface and an outboard stop surface in proximity to said inboard gib and an outboard stop surface in proximity to said outboard gib, each said bolster inboard stop surface and bolster outboard stop surface are acutely angled in opposite directions from said bolster longitudinal axis and said bolster clearance gap, and each said side frame forward and rearward column stop surface having an inboard stop surface and an outboard stop surface in proximity to said respective inboard and outboard bolster gib, said side-frame inboard and outboard stop surfaces are acutely angled from said column surface and said bolster axis at an angle equal to said bolster stop surface angle to provide said respective inboard and outboard, side-frame and bolster stop surfaces in facing alignment at said reference position.

6. In a railcar truck assembly as claimed in claim 1 further comprising a plurality of wear plates, each said wear plate having at least one wearing surface, at least one of said wear plates secured to each said bolster forward side and rearward side in said clearance gap with said wear-plate wearing surface facing, respectively, said side-frame forward and rearward column surface in proximity to said bolster clearance gap, said bolster forward side and rearward side wear plate wearing surface operable to contact said respective side-frame column and column-stop surface to provide a durable contact surface for said side frame.

7. In a railcar truck assembly as claimed in claim 2 wherein each said friction shoe pocket cooperates with the inboard gib and outboard gib at each said bolster forward side and rearward side to define an inboard stop surface and an outboard stop surface, respectively, between each said friction shoe pocket and said respective inboard gib and outboard gib.

8. In a railcar truck assembly as claimed in claim 7 further comprising a plurality of wear plates, each said wear plate having a vertical wearing surface, at least one of said wear plates secured to each said side frame column surface with said wearing surface facing said friction-shoe wearing surface, said bolster inboard stop surface and outboard stop surface in facing alignment with adjacent said side-frame column stop surface and in alignment with said respective bolster clearance gap.

9. In a railcar truck assembly as claimed in claim 7 further comprising a plurality of wear plates, each said wear plate having a vertical wearing surface, at least one of said wear plates secured to each said side frame column surface with said wear-plate wearing surface facing said friction-shoe wearing surface, said bolster inboard and outboard stop surfaces at each respective bolster-end forward side and rearward side in facing alignment with said wear plate vertical surface and operable to contact said wear plate vertical surface to control said warp angle and railcar truck hunting.

10. In a railcar truck assembly as claimed in claim 7 wherein each said bolster inboard stop surface and bolster outboard stop surface are acutely angled in the same direction from said bolster longitudinal axis and said bolster clearance, said side-frame inboard and outboard stop surfaces are acutely angled from said column surface and said bolster axis at an angle equal to its respective facing bolster stop surface at said reference position.

11. In a railcar truck assembly as claimed in claim 7 wherein at least one of said bolster inboard stop surface and bolster outboard stop surface is acutely angled from said bolster longitudinal axis and said bolster clearance, said facing side-frame inboard and outboard stop surface is acutely angled from said column surface and said bolster axis at an angle equal to its respective facing bolster stop surface at said reference position.

12. In a railcar truck assembly as claimed in claim 7 wherein said bolster inboard stop surface and said outboard stop surface are parallel, said bolster inboard and outboard stop surfaces in facing alignment with said wear plate vertical surface and operable to contact said wear plate vertical surface.

13. In a railcar truck assembly as claimed in claim 7 wherein said bolster inboard stop surface and said bolster outboard stop surface are coplanar, said bolster inboard and outboard stop surfaces in facing alignment with said wear plate vertical wearing surface and operable to contact said wear plate vertical wearing surface.

14. In a railcar truck assembly as claimed in claim 1 wherein each said column stop surface and each said bolster stop surface further include one of a hardened surface and a surface coated with a hard wearing material.

15. In a railcar truck assembly as claimed in claim 3 wherein said wear plate in proximity to said bolster stop surface is provided with a separation gap therebetween.

16. In a railcar truck assembly as claimed in claim 15 wherein said bolster stop surface and wear plate wearing surface in proximity to said bolster stop surface cooperate to define a separation gap therebetween, said bolster axis and said side frame axis about perpendicular at said reference position and cooperating to define said warp angle between said axes at displacement of said side frame axis and bolster axis from said reference position, said bolster stop surface contacting said wear plate when said warp angle is greater than two degrees of angular displacement.

17. In a railcar truck assembly as claimed in claim 3 wherein said bolster stop surface and said wear plate in proximity to said bolster stop surface has said separation gap therebetween, said bolster axis and said side frame axis about perpendicular at said reference position and cooperating to define said warp angle between said axes at displacement of said side frame axis and bolster axis from said reference position, said bolster stop surface contacting said wear plate when said warp angle is greater than one-tenth degree of angular displacement.

18. A railcar truck assembly having a first longitudinal axis, a first side frame, a second side frame, each said side frame having a side-frame width, a forward column and a rearward column, said forward and rearward column of each said side frame cooperating to define an opening, a bolster having a longitudinal axis and extending between said first and second side frame openings, each said first and second side frame having a longitudinal axis parallel to said first axis and to each other, said side frame forward and rearward columns generally parallel and in facing alignment to each other, a midpoint along said sideframe longitudinal axis between said forward and rearward column of each said sideframe, said bolster extending through said opening of each said first and second side frame, said bolster having a first end, a second end, a forward side and a rearward side at each of said bolster first and second ends, one of said bolster forward and rearward sides in proximity to one of said forward and rearward side frame columns and the other of said forward and rearward sides in proximity to the other of said forward and rearward side frame columns at each said bolster end, an inboard gib and an outboard gib at each of said bolster forward sides and rearward sides at each said bolster first end and second end, each of said inboard and outboard gibs at each said bolster forward side and rearward side cooperating to define a bolster clearance gap between said inboard and outboard gibs greater than said side frame width, a plurality of friction shoes, each said friction shoe having a wearing face, each said bolster first end and second end having a friction shoe pocket at each said bolster forward side and rearward side, each said bolster forward side and rearward side defining an inboard bolster stop surface between said friction shoe pocket and said inboard gib, and an outboard bolster stop surface between said friction shoe pocket and said outboard gib, a friction shoe provided in each said friction shoe pocket, a plurality of wear plates, each said wear plate having a wearing surface, a wear plate provided on each said forward and rearward side frame column opposite said respective friction shoe wearing surface and bolster stop surface, each said side frame column having an inboard stop surface and an outboard stop surface, said wear plate secured between said side-frame inboard and outboard stop surfaces, said side-frame inboard stop surface, outboard stop surface and said wear-plate wearing surface being coplanar to each other, said bolster inboard and outboard stop surfaces coplanar to each other, each said aligned side frame column surface and bolster forward and rearward side having said side frame inboard and outboard stop surfaces in a facing relationship to said bolster inboard and outboard stop surfaces at a reference position, when said bolster longitudinal axis is aligned with said midpoint between said forward and rearward column surfaces in each said opening at a reference position, said facing bolster stop-surface and column stop-surface cooperate to define a separation gap between said facing stop-surfaces, said separation gap being greater than fifteen thousandths inch and substantially less than ninety-three thousandths at said reference position, which bolster stop surfaces are operable to contact the opposed side frame stop surfaces to maintain control of warping during curving and hunting of a railcar truck assembly utilizing said bolster and side frame members.

19. A railcar truck assembly as claimed in claim 1, wherein said wear plate on each said column surface extends over said inboard and outboard column stop surfaces on said column, said wear plate on said column stop surfaces operable to contact said bolster stop surfaces.

20. In a railcar truck assembly as claimed in claim 19 wherein said wear plate on each said column surface in proximity to an adjacent said bolster stop surface is provided with a separation gap therebetween.

21. In a railcar truck assembly as claimed in claim 20 wherein said wear plate on each said column surface is in proximity to an adjacent said bolster stop surface, said wear plate and bolster stop surface cooperate to define a separation gap therebetween, said bolster axis and said side frame axis about perpendicular at said reference position and cooperating to define said warp angle between said axes at displacement from said reference position, said bolster stop surface contacting said wear plate when said warp angle is greater than two degrees of angular displacement.

22. In a railcar truck assembly as claimed in claim 20 wherein each said wear plate on a column surface is in proximity to an adjacent said bolster stop surface, said wear plate and adjacent bolster stop surface cooperating to define said separation gap therebetween, said bolster axis and said side frame axis about perpendicular at said reference position and cooperating to define said warp angle between said axes at displacement from said reference position, said bolster stop surface contacting said wear plate when said warp angle is greater than one-tenth degree of angular displacement from said reference position.

23. In a railcar truck assembly as claimed in claim 7 wherein each said bolster inboard stop surface and bolster outboard stop surface are acutely angled in opposite directions from said bolster longitudinal axis and said bolster clearance gap, said side-frame inboard and outboard stop surfaces acutely angled from said column surface and said bolster axis at an angle equal to said bolster stop surface angle to provide said respective inboard and outboard, side-frame and bolster stop surfaces in facing alignment at said reference position.

24. In a railcar truck assembly as claimed in claims 23 wherein each said column stop surface and each said bolster stop surface are provided with one of a hardened surface and a surface coated with a hard wearing material.

25. In a railcar truck assembly as claimed in laim 23 wherein said side frame stop surfaces are in proximity to adjacent said bolster stop surfaces, said sideframe stop surfaces and bolster stop surfaces cooperating to define a separation gap therebetween.

26. In a railcar truck assembly as claimed in claim 23 wherein said side frame stop surfaces are in proximity to adjacent said bolster stop surfaces, said adjacent side frame stop surfaces and bolster stop surfaces cooperating to define a separation gap therebetween, said bolster axis and said side frame axis about perpendicular at said reference position and cooperating to define said warp angle between said axes at displacement from said reference position, said bolster stop surfaces contacting said adjacent side frame stop surfaces when said warp angle is greater than two degrees of angular displacement.

* * * * *